US010760272B2

(12) United States Patent
Lee

(10) Patent No.: US 10,760,272 B2
(45) Date of Patent: Sep. 1, 2020

(54) REBAR COUPLER

(71) Applicant: Yang Oun Lee, Gimhae-si (KR)

(72) Inventor: Yang Oun Lee, Gimhae-si (KR)

( * ) Notice: Subject to any disclaimer, the term of this patent is extended or adjusted under 35 U.S.C. 154(b) by 0 days.

(21) Appl. No.: 16/288,213

(22) Filed: Feb. 28, 2019

(65) Prior Publication Data

US 2019/0368196 A1 Dec. 5, 2019

(30) Foreign Application Priority Data

Jun. 4, 2018 (KR) ..... 10-2018-0064058

(51) Int. Cl.
*E04C 5/16* (2006.01)

(52) U.S. Cl.
CPC ..... *E04C 5/162* (2013.01); *E04C 5/163* (2013.01); *E04C 5/166* (2013.01)

(58) Field of Classification Search
CPC .. F21V 21/26; F16C 11/04; Y10T 403/32368; E04B 2001/5868; F16M 11/06; E04C 5/162; E04C 5/166; E04C 5/163
See application file for complete search history.

(56) References Cited

U.S. PATENT DOCUMENTS 5,228,535 A * 7/1993 McCarty ..... E06C 1/32 182/163
5,661,942 A * 9/1997 Palmer ..... E04H 15/48 135/156
6,902,200 B1 * 6/2005 Beadle ..... F16C 11/04 285/185
8,840,611 B2 * 9/2014 Mullaney ..... A61B 17/6466 606/59
9,943,337 B2 * 4/2018 Muniz ..... A61B 17/6466
2004/0103609 A1 * 6/2004 Wostal ..... E04B 2/8617 52/426
2015/0184383 A1 * 7/2015 Foderberg ..... E04C 2/049 52/405.1

FOREIGN PATENT DOCUMENTS

CN 103541514 A * 1/2014
JP H07-010151 U 2/1995
KR 20-2010-0006764 A 7/2010
KR 20-0457733 Y1 1/2012
KR 10-1643846 B1 8/2016
KR 10-2017-0090237 A 8/2017

* cited by examiner

*Primary Examiner* — Basil S Katcheves
*Assistant Examiner* — Omar F Hijaz
(74) *Attorney, Agent, or Firm* — Korus Patent, LLC; Seong Il Jeong

(57) ABSTRACT

A disclosed rebar coupler includes a first coupling member, a second coupling member, and a coupling means. Accordingly, the connection angle between the first coupling member and the second coupling member is variable to a desired angle. The connection angle between rebars to be connected may be rapidly and conveniently varied at an industrial site to which the rebars are applied.

2 Claims, 15 Drawing Sheets

REBAR COUPLER

CROSS-REFERENCE TO RELATED APPLICATION

This application claims the benefit of Korean Patent Application No. 10-2018-0064058 filed on Jun. 4, 2018, which is hereby incorporated by reference herein in its entirety.

BACKGROUND

1. Technical Field

The present invention relates to a rebar coupler.

2. Description of the Related Art

Rebar couplers are used to connect rebars at industrial sites, such as construction sites. Examples of such rebar couplers are disclosed in Korean Patent No. 10-1643846 entitled "One Touch-type Automatic Rebar Coupler" and issued on Jul. 22, 2016 and Korean Utility Model Registration No. 20-2010-0006764 entitled "Rebar Coupler Capable of Connecting Rebars in Cross Shape" and published on Jul. 2, 2010.

However, according to the conventional rebar couplers, the angles at which rebars are coupled to the rebar couplers are fixed, and thus it is impossible to adjust the connection angle between rebars to be connected. Accordingly, a problem arises in that when it is required to adjust the connection angle between rebars to be connected at an industrial site to which the rebars are applied, a separate rebar coupler must be fabricated.

SUMMARY

An object of the present invention is to provide a rebar coupler that enables the connection angle between rebars, to be connected, to be rapidly and conveniently varied at an industrial site to which the rebars are applied.

According to one aspect of the present invention, there is provided a rebar coupler including: a first coupling member configured such that one of a plurality of rebars to be connected is connected thereto; a second coupling member configured such that another of the plurality of rebars to be connected is connected thereto; and a coupling means configured to connect the first coupling member and the second coupling member to each other;

wherein the connection angle between the first coupling member and the second coupling member is variable to a desired angle.

According to another aspect of the present invention, there is provided a rebar coupler including: a first coupling member configured such that two of a plurality of rebars to be connected are connected thereto; a second coupling member configured such that other two of the plurality of rebars to be connected are connected thereto; and a coupling means configured to connect the first coupling member and the second coupling member to each other;

wherein the first coupling member and the second coupling member cross each other at a right angle.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Rebar couplers according to embodiments of the present invention will be described in detail below with reference to the accompanying drawings.

Figure 1:
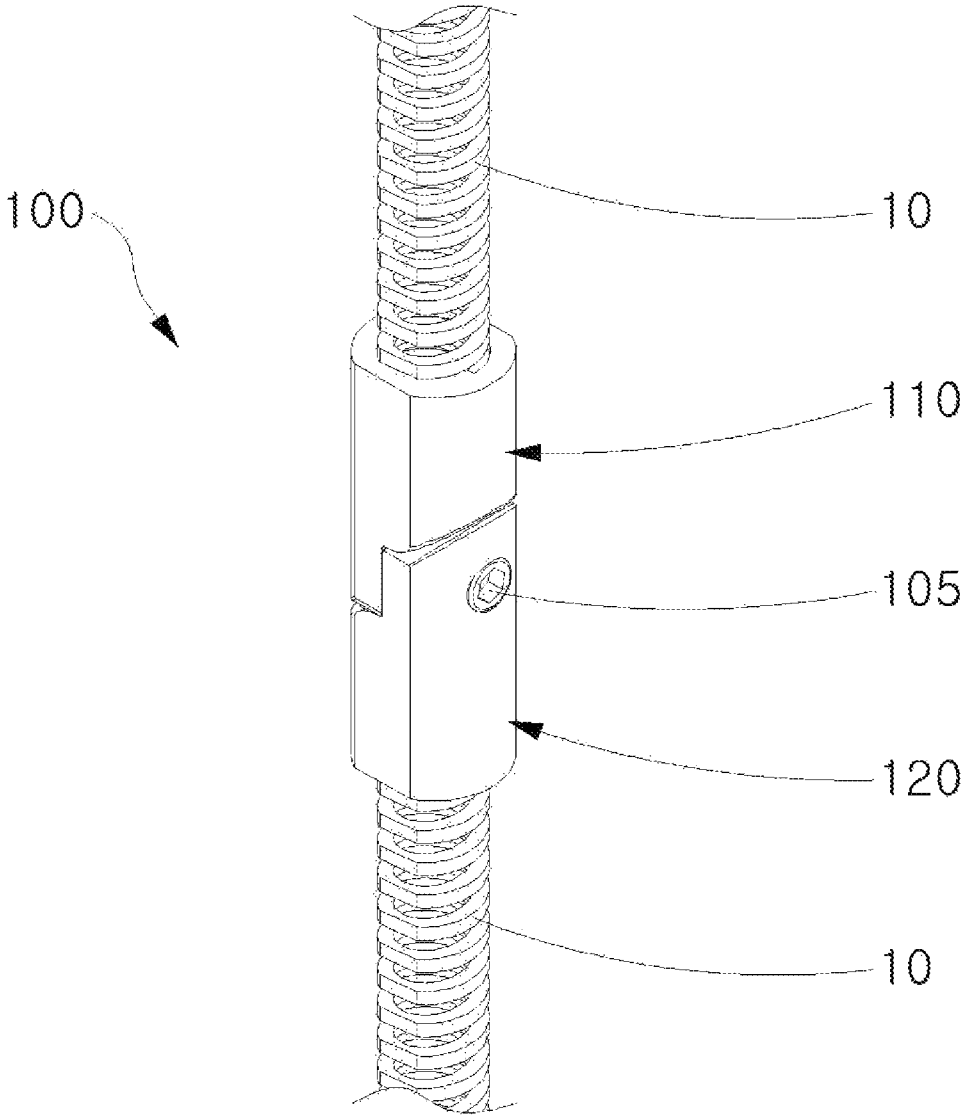
FIG. 1 is a perspective view showing a state in which a rebar coupler according to a first embodiment of the present invention is spread.
Figure 2:
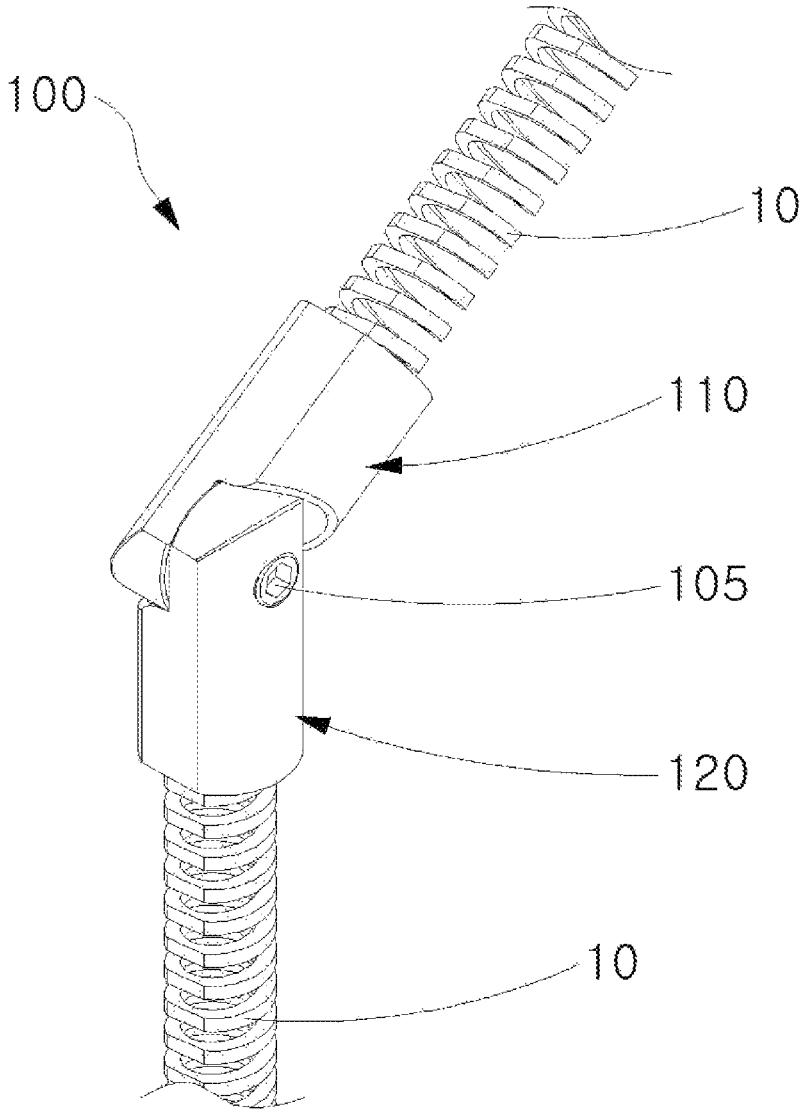
FIG. 2 is a perspective view showing a state in which the rebar coupler according to the first embodiment of the present invention is bent.
Figure 3:
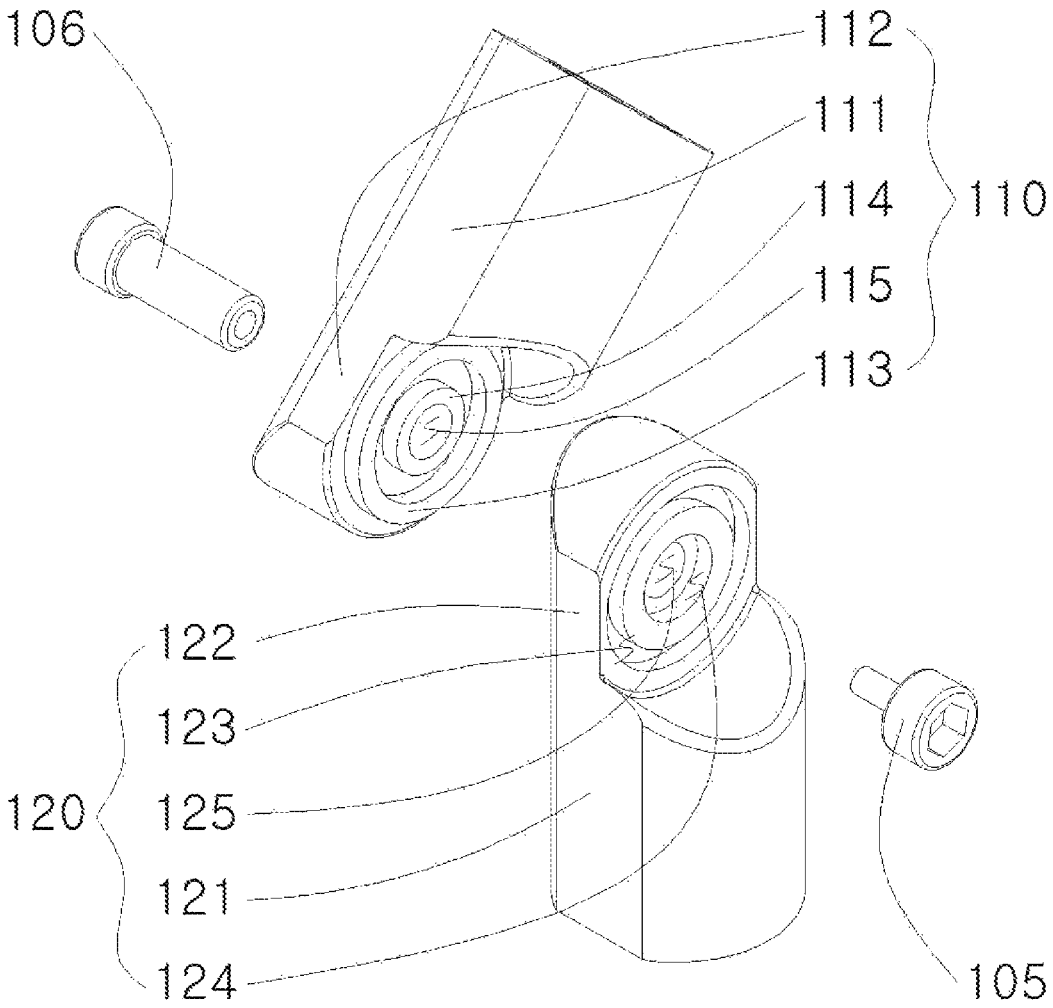
FIG. 3 is a perspective view showing a state in which the rebar coupler according to the first embodiment of the present invention is exploded.
Figure 4:
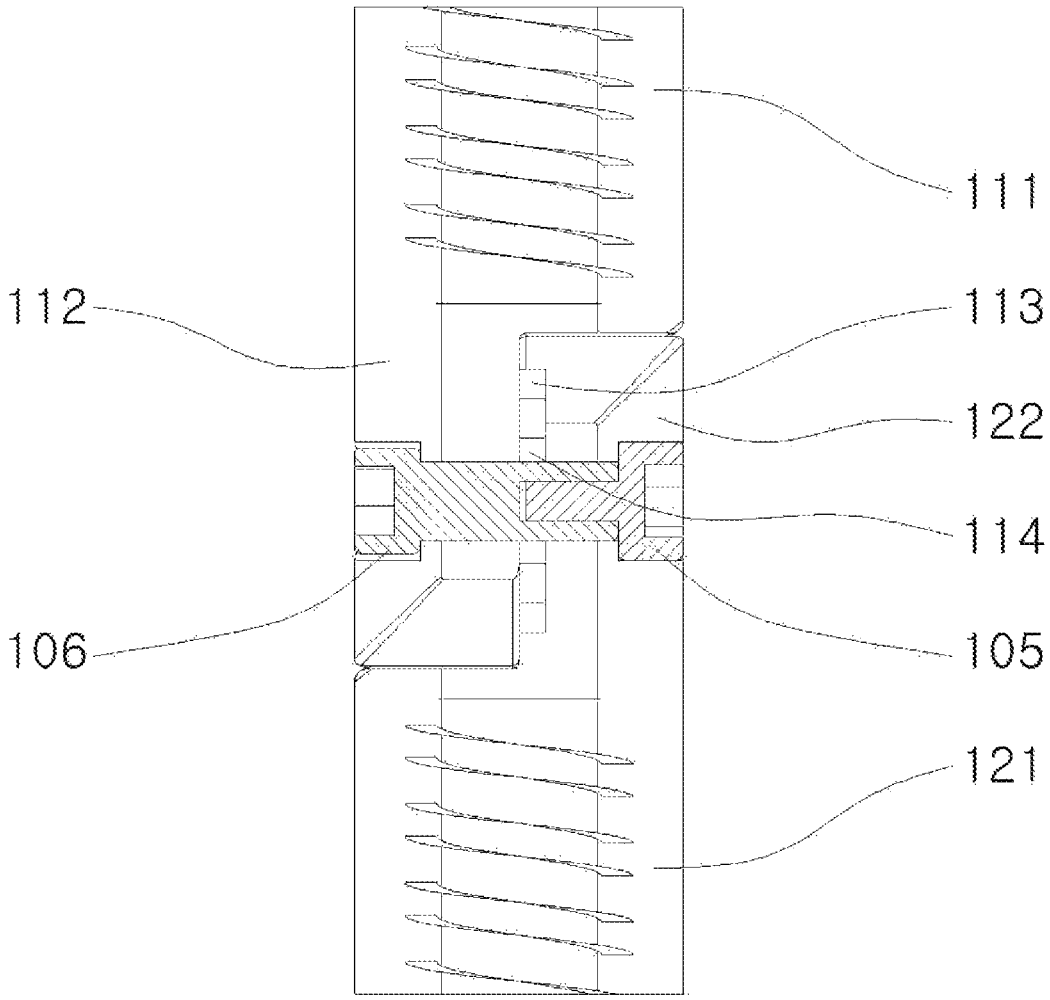
FIG. 4 is a sectional view showing a state in which the rebar coupler according to the first embodiment of the present invention is spread.
Figure 5:
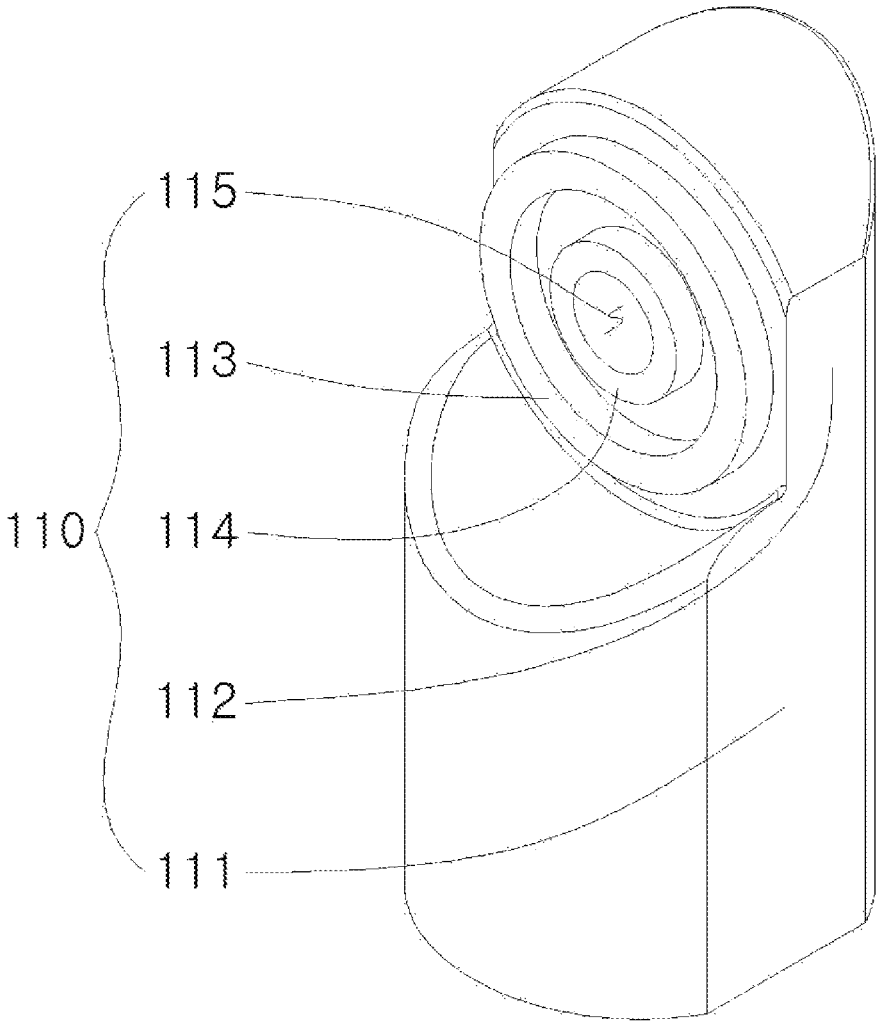
FIG. 5 is a perspective view showing a first coupling member constituting part of the rebar coupler according to the first embodiment of the present invention.
Figure 6:
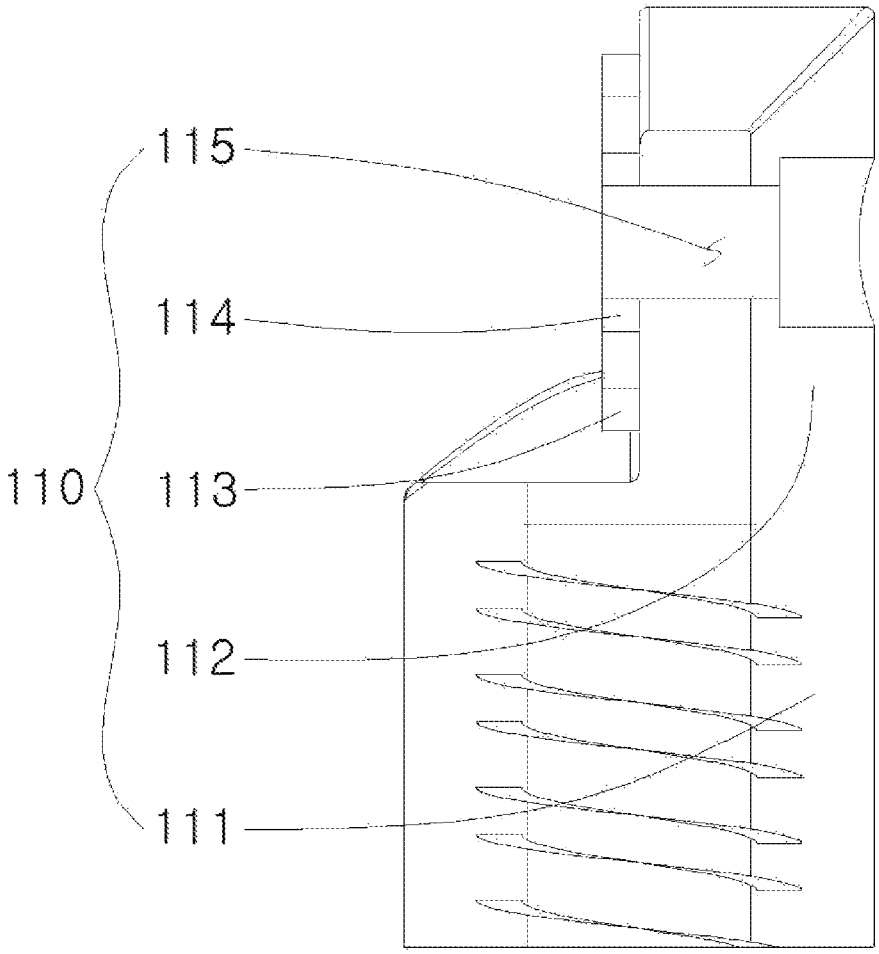
FIG. 6 is a sectional view showing the first coupling member constituting part of the rebar coupler according to the first embodiment of the present invention.
Figure 7:
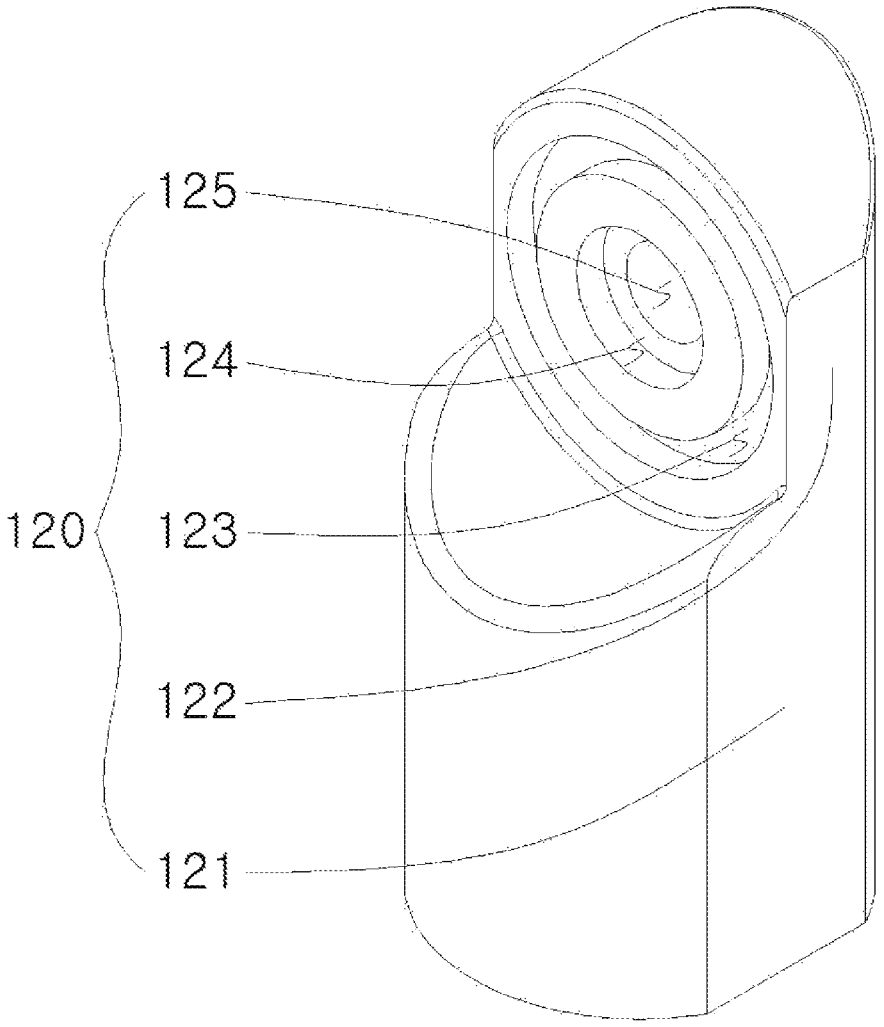
FIG. 7 is a perspective view showing a second coupling member constituting part of the rebar coupler according to the first embodiment of the present invention.
Figure 8:
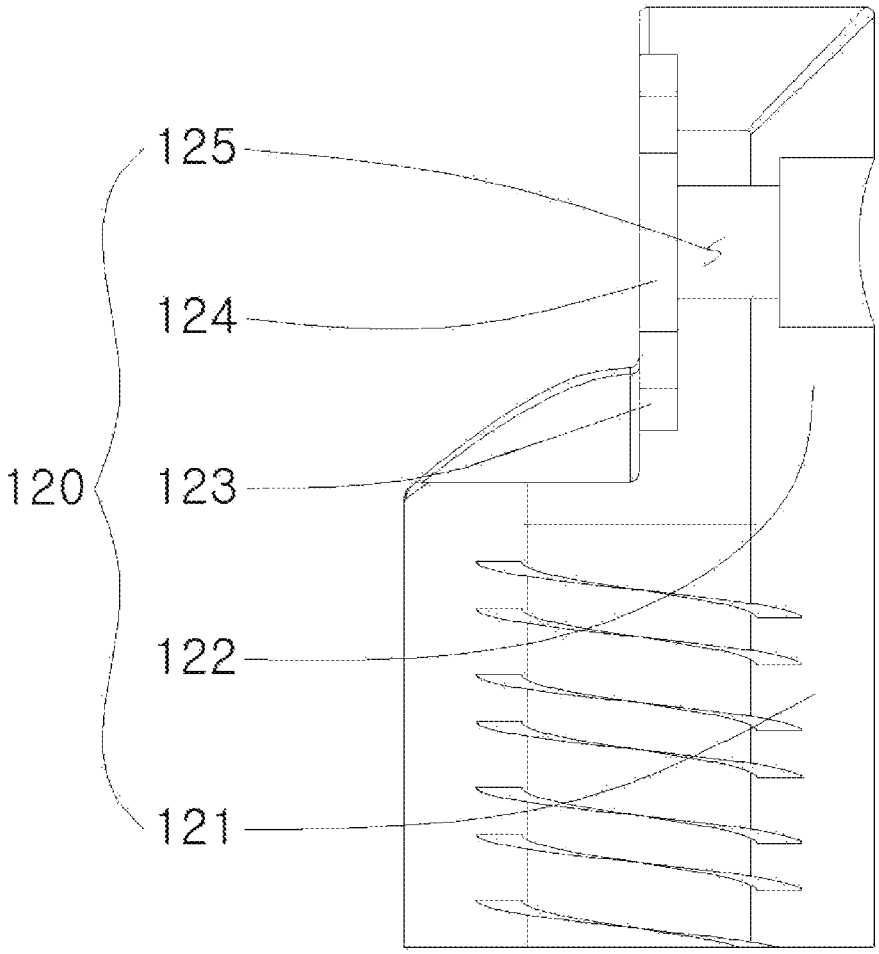
FIG. 8 is a sectional view showing the second coupling member constituting part of the rebar coupler according to the first embodiment of the present invention.

FIG. 1 is a perspective view showing a state in which a rebar coupler according to a first embodiment of the present invention is spread, FIG. 2 is a perspective view showing a state in which the rebar coupler according to the first embodiment of the present invention is bent, FIG. 3 is a perspective view showing a state in which the rebar coupler according to the first embodiment of the present invention is exploded, FIG. 4 is a sectional view showing a state in which the rebar coupler according to the first embodiment of the present invention is spread, FIG. 5 is a perspective view showing a first coupling member constituting part of the rebar coupler according to the first embodiment of the present invention, FIG. 6 is a sectional view showing the first coupling member constituting part of the rebar coupler according to the first embodiment of the present invention, FIG. 7 is a perspective view showing a second coupling member constituting part of the rebar coupler according to the first embodiment of the present invention, and FIG. 8 is a sectional view showing the second coupling member constituting part of the rebar coupler according to the first embodiment of the present invention.

Referring to FIGS. 1 to 8 together, the rebar coupler 100 according to the present embodiment includes a first coupling member 110, a second coupling member 120, and a coupling means 105 and 106. The connection angle between the first coupling member 110 and the second coupling member 120 may be varied to a desired angle.

One of a plurality of rebars 10 to be connected is connected to the first coupling member 110.

In detail, the first coupling member 110 includes: a first coupling body 111 configured such that one of the plurality of rebars 10 to be connected is connected thereto; a first coupling connection portion 112 configured to extend from the part of the first coupling body 111 opposite to the part of the first coupling body 111 to which the one of the plurality of rebars 10 to be connected is connected; a coupling outer ring-shaped protrusion 113 configured to protrude from the surface of the first coupling connection portion 112, engaging with the second coupling member 120, in a ring shape; and a coupling inner ring-shaped protrusion 114 configured to protrude from the surface of the first coupling connection portion 112, engaging with the second coupling member 120, in a ring shape while having the same center as the coupling outer ring-shaped protrusion 113 but a smaller diameter than the coupling outer ring-shaped protrusion 113.

The first coupling body 111 is formed in a long rod shape having a predetermined length. A first reception hole configured to receive one end portion of the one of the plurality of rebars 10 to be connected is formed in one end of the first coupling body 111.

The first coupling connection portion 112 is formed on the side of the first coupling body 111 opposite to the side of the first coupling body 111 in which the first reception hole is formed. The surface of the first coupling connection portion 112 that engages with the second coupling member 120 is formed to a predetermined depth.

The coupling inner ring-shaped protrusion 114 and the coupling outer ring-shaped protrusion 113 protrude from the surface of the first coupling connection portion 112, engaging with the second coupling member 120, in band shapes having a predetermined height while having the same center.

Meanwhile, the first coupling member 110 further includes a first coupling through hole 115. The first coupling through hole 115 passes through the first coupling connection portion 112 while having the same center as the coupling outer ring-shaped protrusion 113 and the coupling inner ring-shaped protrusion 114. The coupling means 105 and 106 is inserted into the first coupling through hole 115.

Another of the plurality of rebars 10 to be connected is connected to the second coupling member 120.

In detail, the second coupling member 120 includes: a second coupling body 121 configured such that another of the plurality of rebars 10 to be connected is connected thereto; a second coupling connection portion 122 configured to extend from the part of the second coupling body 121 opposite to the part of the second coupling body 121 to which the other of the plurality of rebars 10 to be connected is connected; a coupling outer ring-shaped groove 123 depressed through the surface of the second coupling connection portion 122, engaging with the first coupling connection portion 112, in a ring shape, and configured to rotatably receive the coupling outer ring-shaped protrusion 113; and a coupling inner ring-shaped groove 124 depressed through the surface of the second coupling connection portion 122, engaging with the first coupling connection portion 112, in a ring shape while having the same center as the coupling outer ring-shaped groove 123 but a smaller diameter than the coupling outer ring-shaped groove 123, and configured to rotatably receive the coupling inner ring-shaped protrusion 114.

The second coupling body 121 is formed in a long rod shape having a predetermined length. A second reception hole configured to receive one end portion of the other of the plurality of rebars 10 to be connected is formed in one end of the second coupling body 121.

The second coupling connection portion 122 is formed on the side of the first coupling body 111 opposite to the side of the second coupling body 121 in which the second reception hole is formed. The surface of the second coupling connection portion 122 that engages with the first coupling member 110 is formed to a predetermined depth.

The coupling inner ring-shaped groove 124 and the coupling outer ring-shaped groove 123 are recessed through the surface of the second coupling connection portion 122, engaging with the first coupling member 110, in band shapes having a predetermined depth while having the same center.

Meanwhile, the second coupling member 120 further includes a second coupling through hole 125. The second coupling through hole 125 passes through the second coupling connection portion 122 while having the same center as the coupling outer ring-shaped groove 123 and the coupling inner ring-shaped groove 124. The coupling means 105 and 106 is inserted into the second coupling through hole 125.

When the coupling outer ring-shaped protrusion 113 and the coupling inner ring-shaped protrusion 114 are inserted into the coupling outer ring-shaped groove 123 and the coupling inner ring-shaped groove 124, respectively, the first coupling through hole 115 and the second coupling through hole 125 communicate with each other. Accordingly, the coupling means 105 and 106 may be smoothly inserted into the first coupling through hole 115 and the second coupling through hole 125.

The coupling means 105 and 106 connects the first coupling member 110 and the second coupling member 120 to each other.

In detail, the coupling means 105 and 106 includes a female coupler 106 and a male coupler 105.

The female coupler 106 is brought from the outside of any one of the first coupling through hole 115 and the second coupling through hole 125, and is sequentially passed through the first coupling through hole 115 and the second coupling through hole 125 that communicate with each other. A coupling hole is formed through one surface of the female coupler 106 to a predetermined depth in a longitudinal direction.

The male coupler 105 is brought from the outside of the other one of the first coupling through hole 115 and the second coupling through hole 125, and is then fitted into the coupling hole of the female coupler 106 in the state of having been sequentially passed through the first coupling through hole 115 and the second coupling through hole 125, thereby connecting the first coupling member 110 and the second coupling member 120 to each other.

For example, the female coupler 106 may be brought from the outside of the first coupling through hole 115 and be sequentially passed through the first coupling through hole 115 and the second coupling through hole 125, and the male coupler 105 may be brought from the outside of the second coupling through hole 125 and be then fitted into the coupling hole of the female coupler 106.

Threads are formed on the inner surface of the coupling hole and the outer surface of the male coupler 105 to be engaged with each other, and thus the female coupler 106 and the male coupler 105 may be screwed into each other.

As the first coupling member 110 and the second coupling member 120 are rotatably coupled to each other by the coupling means 105 and 106 as described above, the coupling outer ring-shaped protrusion 113 and the coupling inner ring-shaped protrusion 114 may be rotated in the state of having been inserted into the coupling outer ring-shaped groove 123 and the coupling inner ring-shaped groove 124. Accordingly, the connection angle between the first coupling member 110 and the second coupling member 120 may be rapidly and conveniently varied to a desired connection angle.

In the state in which the connection angle between the first coupling member 110 and the second coupling member 120 has been varied to the desired connection angle, the male coupler 105 is further rotated by the external force of an operator so that the male coupler 105 is more deeply fitted into the female coupler 106, and thus the connection angle between the first coupling member 110 and the second coupling member 120 may be fixed.

It will be apparent that when it is necessary to adjust the connection angle between the first coupling member 110 and the second coupling member 120, the male coupler 105 may be rotated in the direction, opposite to the direction in which the connection angle between the first coupling member 110 and the second coupling member 120 is fixed, by the external force of the operator so that the male coupler 105 may be less deeply fitted into the female coupler 106.

As described above, as the rebar coupler 100 includes the first coupling member 110, the second coupling member 120, and the coupling means 105 and 106, the connection angle between the first coupling member 110 and the second coupling member 120 may be varied to a desired angle, and thus the connection angle between the connected rebars 10 may be rapidly and conveniently varied at an industrial site to which the rebars 10 are applied.

Rebar couplers according to other embodiments of the present invention will be described below with reference to the accompanying drawings. In the following description, descriptions that are the same as the descriptions already given in conjunction with the first embodiment of the present invention will be replaced with the latter, and will be omitted in the following description.

Figure 9:
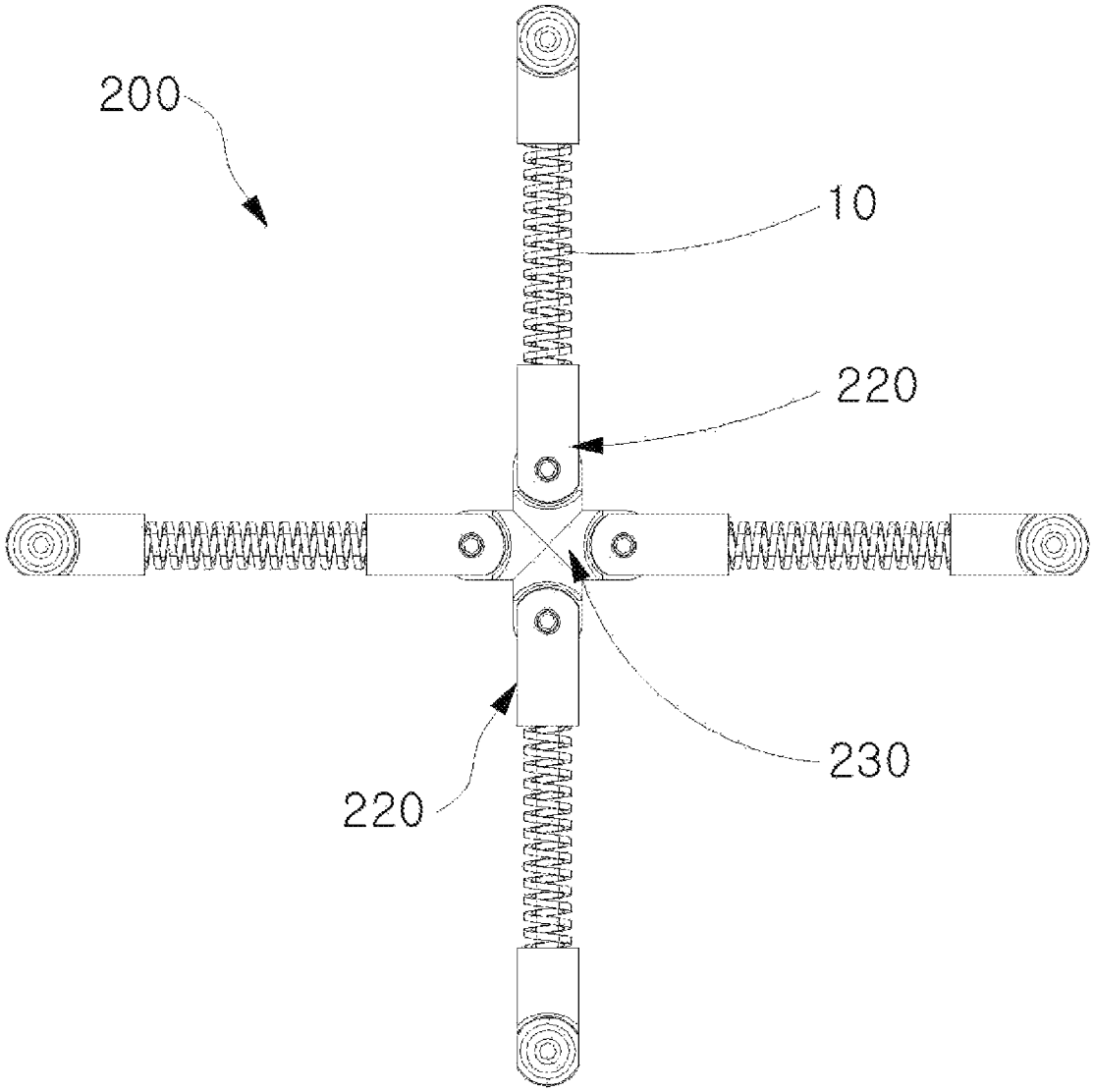
FIG. 9 is a plan view showing the combined appearance of a rebar coupler according to a second embodiment of the present invention when viewed from above.
Figure 10:
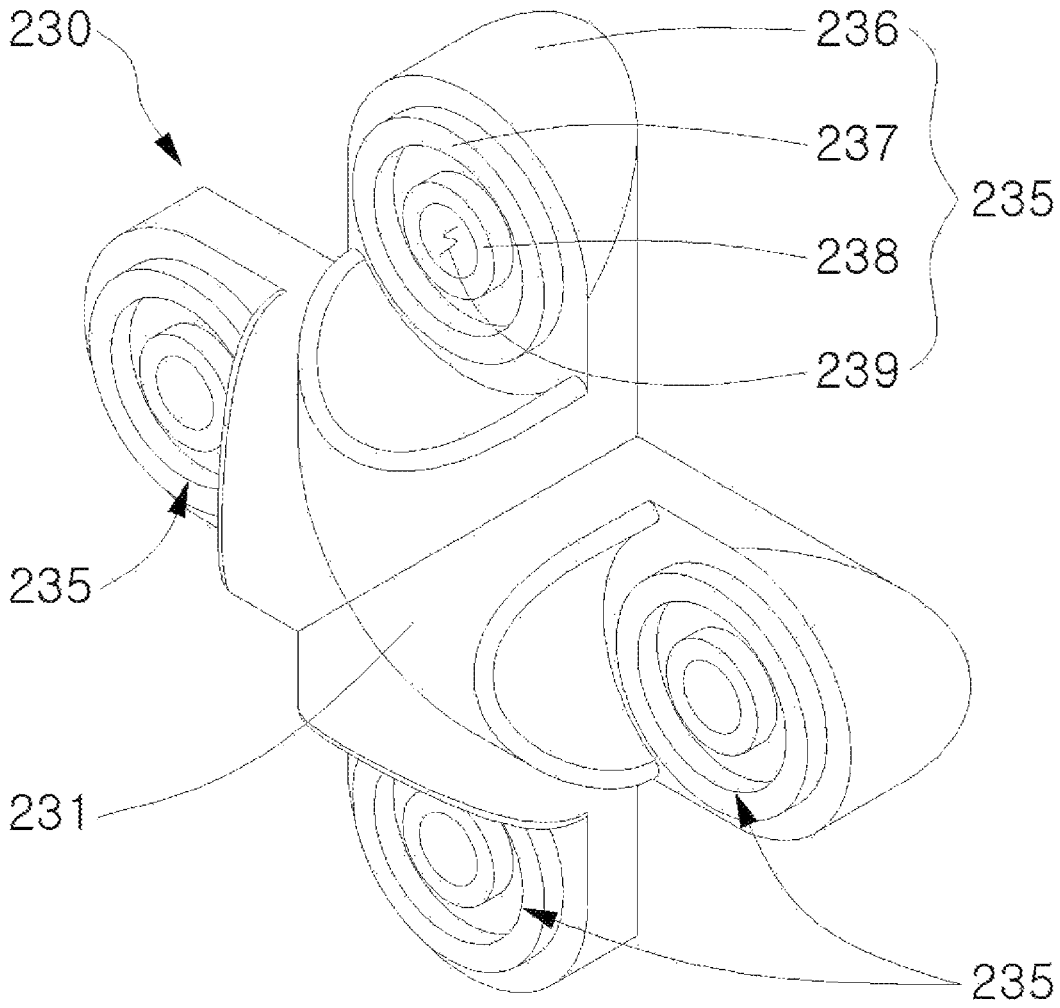
FIG. 10 is a perspective view showing a coupling body member constituting part of the rebar coupler according to the second embodiment of the present invention.

FIG. 9 is a plan view showing the combined appearance of a rebar coupler according to a second embodiment of the present invention when viewed from above, and FIG. 10 is a perspective view showing a coupling body member 230 constituting part of the rebar coupler according to the second embodiment of the present invention.

Referring to FIGS. 9 and 10 together, the rebar coupler 200 according to the present embodiment further includes the coupling body member 230.

At least one of first coupling members and second coupling members 220 is rotatably connected to the coupling body member 230 by a coupling means.

In the present embodiment, the coupling body member 230 includes a coupling body 231, and a plurality of coupling portions 235 formed on a plurality of side surfaces of the coupling body 231 and configured such that at least one of the first coupling members and the second coupling members 220 is rotatably coupled thereto by the coupling means.

In this case, a case where the second coupling member 220 is connected to the coupling portions 235 will be described.

Each of the coupling portions 235 includes: a coupling extension 236 configured to extend from the coupling body 231; an extensional outer ring-shaped protrusion 237 configured to protrude from the coupling extension 236 in a ring shape; an extensional inner ring-shaped protrusion 238 configured to protrude from the coupling extension 236 in a ring shape while having the same center as the extensional outer ring-shaped protrusion 237 but a smaller diameter than the extensional outer ring-shaped protrusion 237; and an extensional coupling through hole 239 configured to pass through the coupling extension 236 while having the same center as the extensional outer ring-shaped protrusion 237 and the extensional inner ring-shaped protrusion 238 and to receive the coupling means.

The extensional outer ring-shaped protrusion 237 and the extensional inner ring-shaped protrusion 238 are rotatably inserted into the coupling outer ring-shaped groove and coupling inner ring-shaped groove of the second coupling member 220, respectively, and thus the connection angle of the second coupling member 220 relative to the coupling portion 235 may be varied.

In the state in which the second coupling member 220 and the coupling portion 235 have been engaged with each other, the coupling means is inserted into the extensional coupling through hole 239 and the second coupling through hole.

The plurality of the coupling portions 235 extends from the coupling body 231 in different directions, and the second coupling members 220 are connected to the plurality of the coupling portion 235 having extended above. Accordingly, the second coupling members 220 may be varied to desired connection angles relative to the coupling body 231.

In the present embodiment, the coupling portions 235 are four in number, and the coupling portions 235 are each formed on each side surface of the coupling body 231 at a right angle.

Figure 11:
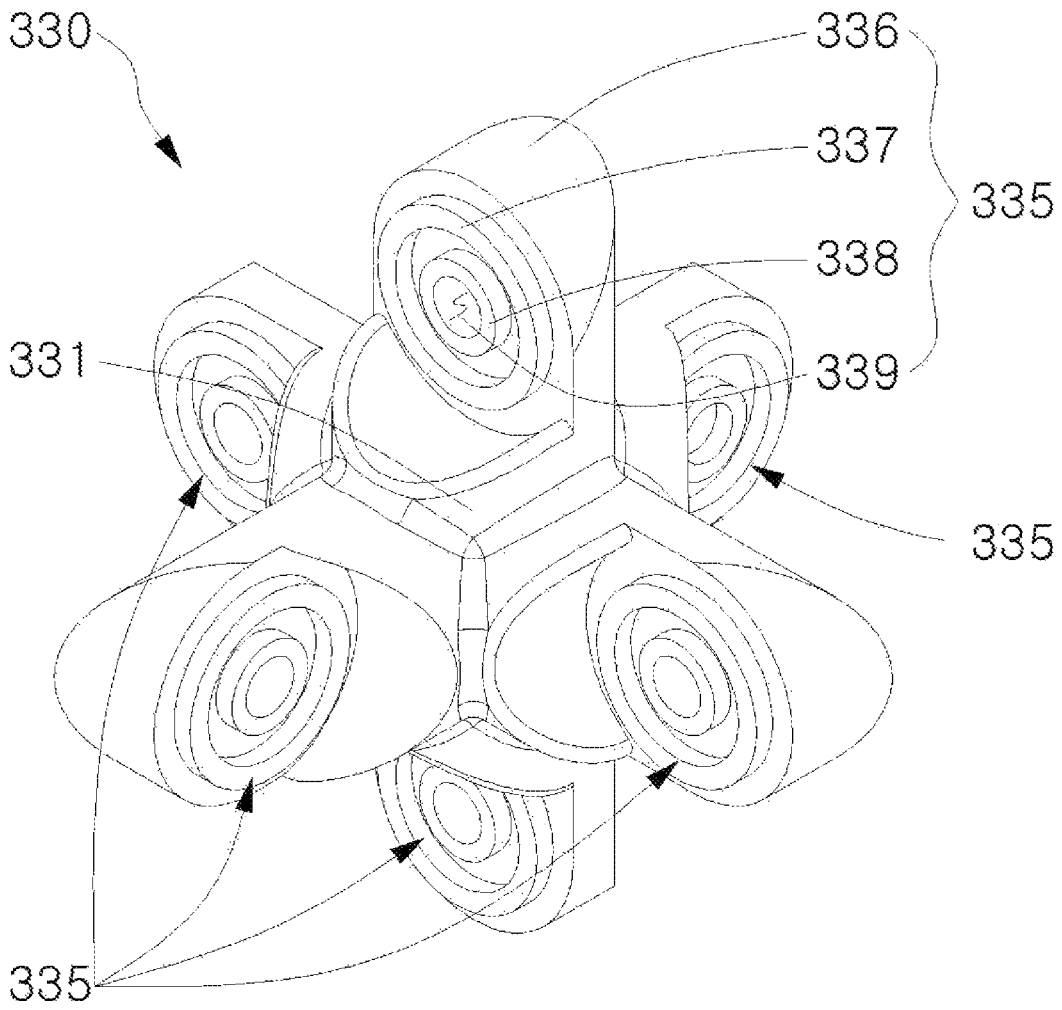
FIG. 11 is a perspective view showing a coupling body member constituting part of a rebar coupler according to a third embodiment of the present invention.

FIG. 11 is a perspective view showing a coupling body member constituting part of a rebar coupler according to a third embodiment of the present invention.

Referring to FIG. 11, in the present embodiment, coupling portions 335 are six in number, with four of the coupling portions 335 being formed on side surfaces of the coupling body 331 while being perpendicular to each other, and two of the coupling portions 335 protruding in front of and behind the coupling body 331, respectively.

Figure 12:
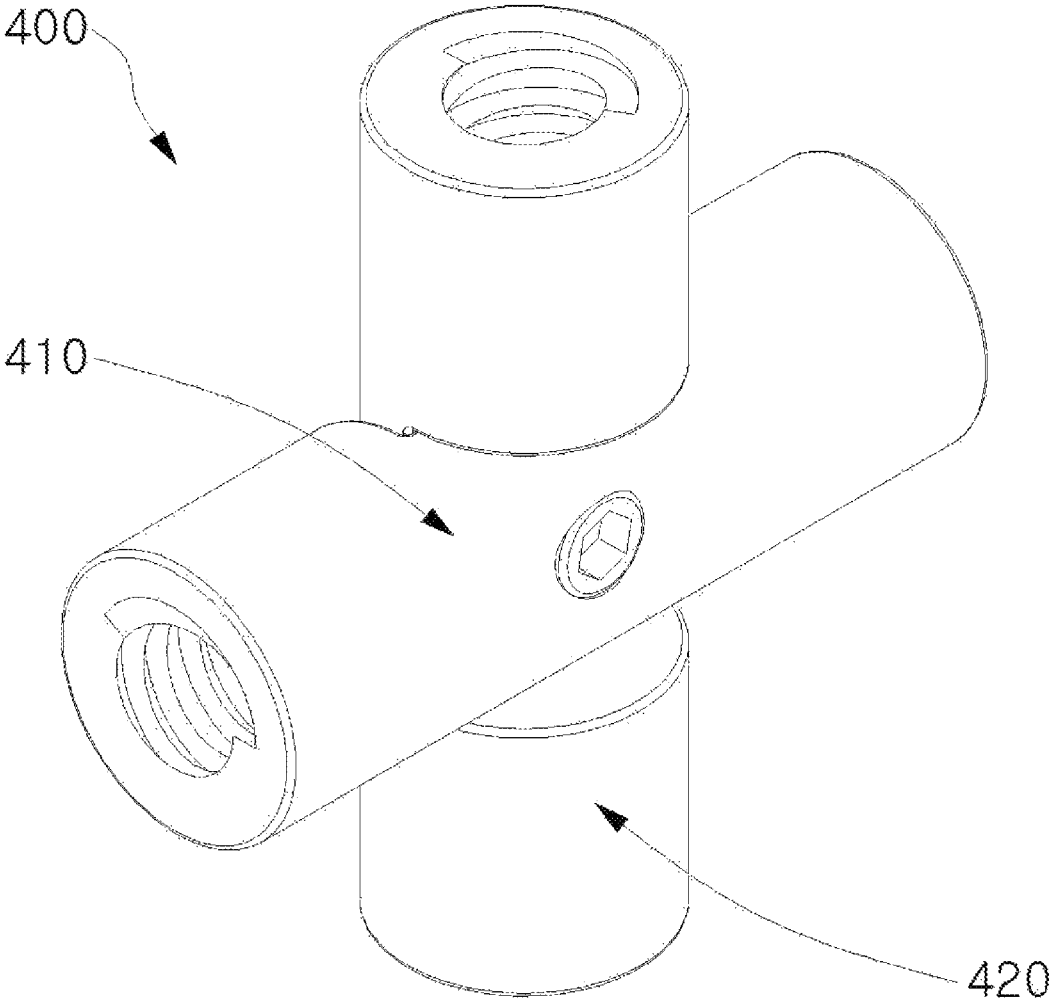
FIG. 12 is a perspective view showing the combined appearance of a rebar coupler according to a fourth embodiment of the present invention.
Figure 13:
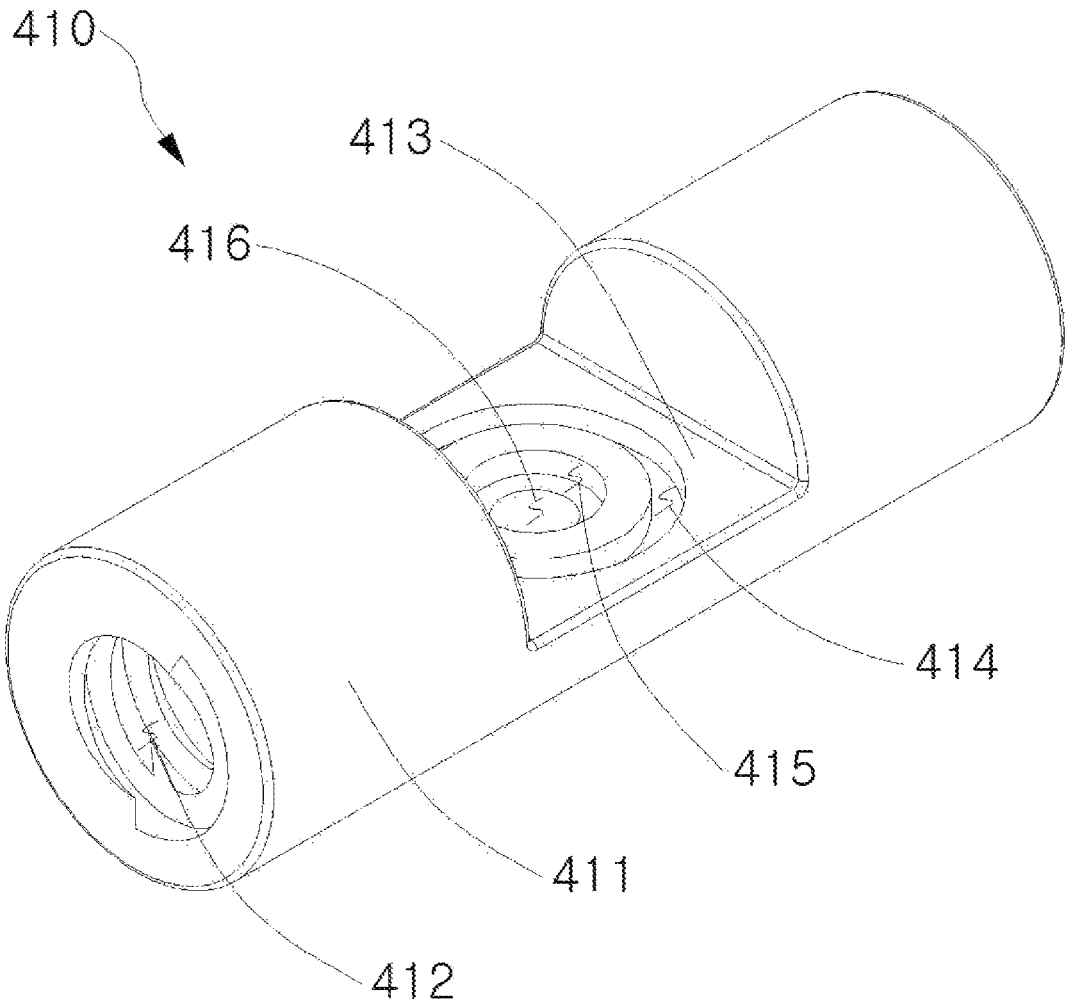
FIG. 13 is a perspective view showing a first coupling member constituting part of the rebar coupler according to the fourth embodiment of the present invention.

FIG. 12 is a perspective view showing the combined appearance of a rebar coupler 400 according to a fourth embodiment of the present invention, and FIG. 13 is a perspective view showing a first coupling member constituting part of the rebar coupler 400 according to the fourth embodiment of the present invention.

Referring to FIGS. 12 and 13 together, the rebar coupler 400 according to the present embodiment includes: a first coupling member 410 configured such that two of a plurality of rebars to be connected are connected both sides thereof; a second coupling member 420 configured such that other two of the plurality of rebars to be connected are connected to both sides thereof; and a coupling means configured to connect the first coupling member 410 and the second coupling member 420 to each other. The first coupling member 410 and the second coupling member 420 cross each other at a right angle.

In detail, the first coupling member 410 includes: a first coupling body 411 configured such that first reception holes 412 are formed in both sides thereof; a first coupling connection portion 413 formed in the center of the first coupling body 411 to a predetermined depth; a coupling outer ring-shaped groove 414 formed through the surface of the first coupling connection portion 413, engaging with the second coupling member 420, in a ring shape; a coupling inner ring-shaped groove 415 formed through the surface of the first coupling connection portion 413, engaging with the second coupling member 420, in a ring shape while having the same center as the coupling outer ring-shaped groove 414 but a smaller diameter than the coupling outer ring-shaped groove 414; and a first coupling through hole 416 configured to pass through the first coupling connection portion 413 while having the same center as the coupling outer ring-shaped groove 414 and the coupling inner ring-shaped groove 415.

The second coupling member 420 includes the coupling outer ring-shaped protrusion, the coupling inner ring-shaped protrusion, and the second coupling through hole that correspond to the coupling outer ring-shaped groove 414, the coupling inner ring-shaped groove 415, and the first coupling through hole 416, respectively.

The first coupling member 410 and the second coupling member 420, which are formed as described above, engage with each other while crossing each other, and thus a plurality of rebars may perpendicularly cross each other in a cross shape.

Figure 14:
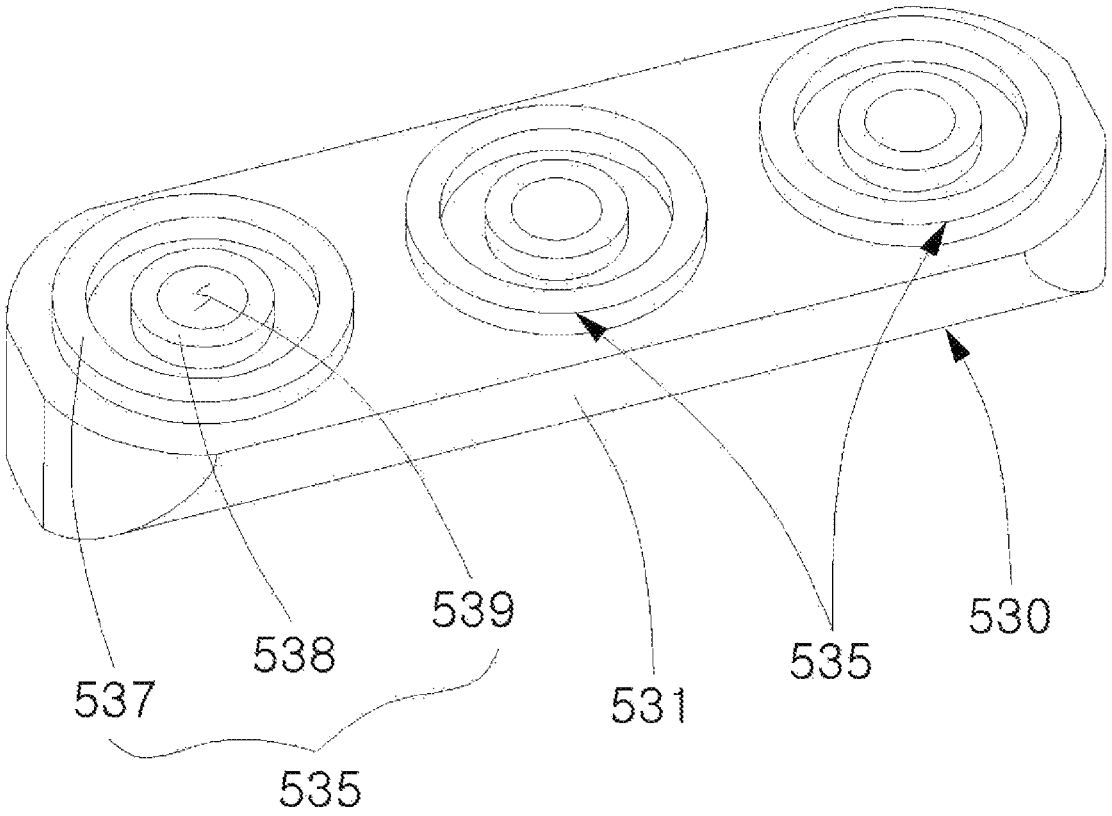
FIG. 14 is a perspective view showing a coupling body member constituting part of a rebar coupler according to a fifth embodiment of the present invention.
Figure 15:
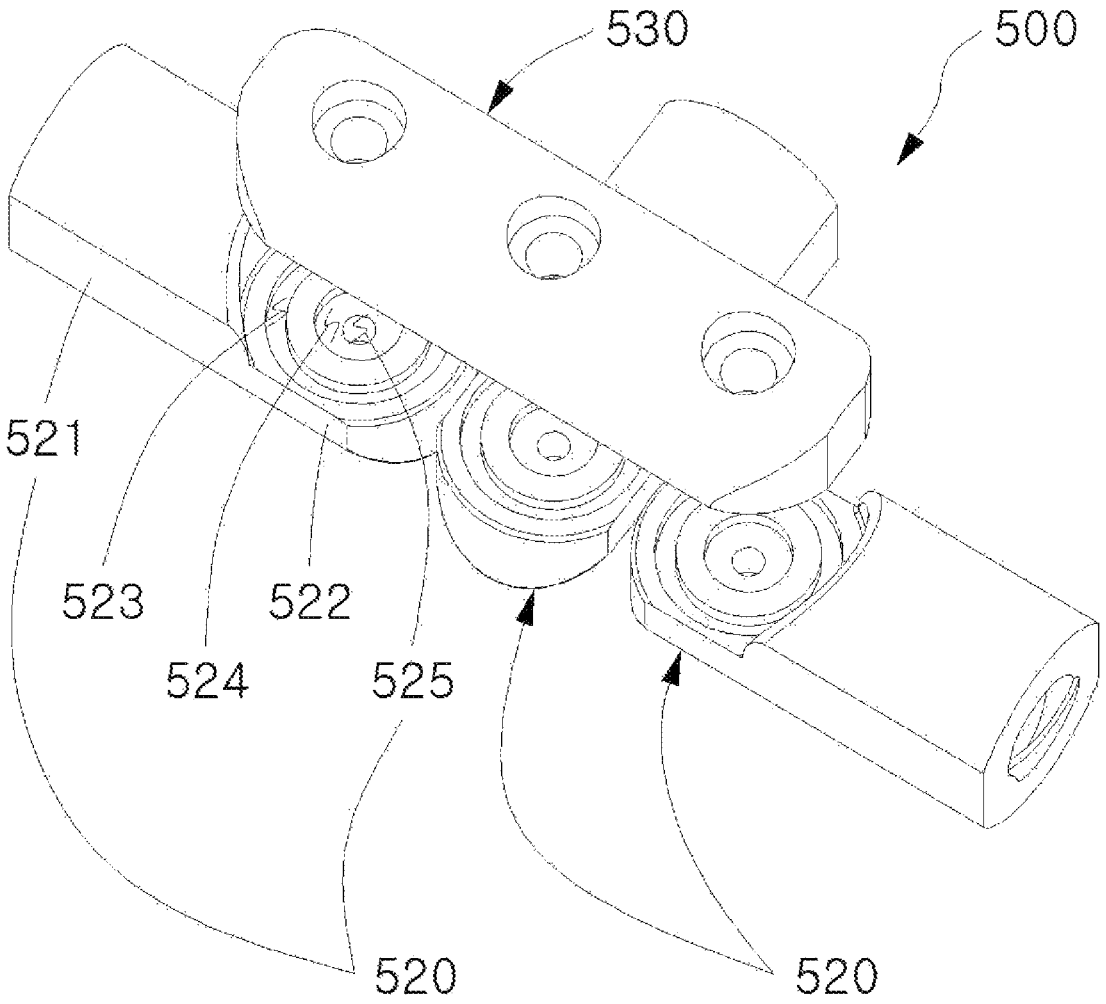
FIG. 15 is a perspective view showing the appearance of the rebar coupler according to the fifth embodiment of the present invention before combination.

FIG. 14 is a perspective view showing a coupling body member constituting part of a rebar coupler 500 according to a fifth embodiment of the present invention, and FIG. 15 is a perspective view showing the appearance of the rebar coupler 500 according to the fifth embodiment of the present invention before combination.

Referring to FIGS. 14 and 15 together, the rebar coupler 500 according to the present embodiment further includes a coupling body member 530.

At least one of a first coupling member and a second coupling member 520 is rotatably connected to the coupling body member 530 by a coupling means.

In the present embodiment, the coupling body member 530 includes: a coupling body 531 formed to a predetermined length; and a plurality of coupling portions 535 arranged on one surface of the coupling body 531 in parallel with each other and each configured such that at least one of the first coupling member and the second coupling member 520 is rotatably coupled thereto by the coupling means.

In this case, a case where the second coupling member 520 is connected to the coupling portion 535 will be described.

Each of the coupling portions 535 includes: an extensional outer ring-shaped protrusion 537 configured to protrude from one surface of the coupling body 531 in a ring shape; an extensional inner ring-shaped protrusion 538 configured to protrude from one surface of the coupling body 531 in a ring shape while having the same center as the extensional outer ring-shaped protrusion 537 but a smaller diameter than the extensional outer ring-shaped protrusion 537; and an extensional coupling through hole 539 configured to pass through the one surface of the coupling body 531 while having the same center as the extensional outer ring-shaped protrusion 537 and the extensional inner ring-shaped protrusion 538 and to receive the coupling means.

The extensional outer ring-shaped protrusion 537 and the extensional inner ring-shaped protrusion 538 are rotatably inserted into the coupling outer ring-shaped groove 523 and coupling inner ring-shaped groove 524 of the second coupling member 520, respectively, and thus the connection angle of the second coupling member 520 relative to the coupling portion 535 may be varied.

In the state in which the second coupling member 520 and the coupling portion 535 have engaged with each other, the coupling means is inserted into the extensional coupling through hole 539 and the second coupling through hole 525.

The plurality of the coupling portions 535 is arranged on one surface of the coupling body 531 in parallel with each other, and second coupling members 520 are connected to the coupling portions 535, respectively. Accordingly, the second coupling members 520 may be varied to respective desired connection angles relative to the coupling body 531.

In the present embodiment, the coupling portions 535 are three in number, and the coupling portions 535 are arranged on one surface of the coupling body 531 in parallel with each other. Then, the second coupling members 520 may be connected to the respective coupling portions 535 in different directions.

For example, two outer second coupling members 520 may be connected in opposite directions, and one center second coupling member 520 may be connected in a direction perpendicular to the two outer second coupling members 520.

In the rebar coupler according to one aspect of the present invention, the rebar coupler includes the first coupling member, the second coupling member, and the coupling means, and thus the connection angle between the first coupling member and the second coupling member may be varied to a desired angle, with the result that the connection angle between rebars to be connected may be rapidly and conveniently varied at an industrial site to which the rebars are applied.

While the present invention has been illustrated and described in conjunction with the specific embodiments, it will be understood by those having ordinary knowledge in the art to which the present invention pertains that the present invention may be modified or altered in various manners without departing from the spirit and scope of the present invention described in the attached claims. Furthermore, all the modifications and alterations will fall within the scope of protection of the present invention.

What is claimed is:

1. A rebar coupler, comprising:

a first coupling member configured such that one of a plurality of rebars to be connected is connected thereto;

a second coupling member configured such that another of the plurality of rebars to be connected is connected thereto; and a coupling means configured to connect the first coupling member and the second coupling member to each other;

wherein a connection angle between the first coupling member and the second coupling member is variable to a desired angle, wherein the first coupling member comprises:

a first coupling body configured such that one of the plurality of rebars to be connected is connected thereto;

a first coupling connection portion configured to extend from a part of the first coupling body opposite to the part of the first coupling body to which the one of the plurality of rebars to be connected is connected;

a coupling outer ring-shaped protrusion configured to protrude from a surface of the first coupling connection portion, engaging with the second coupling member, in a ring shape; and a coupling inner ring-shaped protrusion configured to protrude from the surface of the first coupling connection portion, engaging with the second coupling member, in a ring shape while having a same center as the coupling outer ring-shaped protrusion but a smaller diameter than the coupling outer ring-shaped protrusion;

wherein the second coupling member comprises:

a second coupling body configured such that another of the plurality of rebars to be connected is connected thereto;

a second coupling connection portion configured to extend from a part of the second coupling body opposite to a part of the second coupling body to which the other of the plurality of rebars to be connected is connected;

a coupling outer ring-shaped groove depressed through a surface of the second coupling connection portion, engaging with the first coupling connection portion, in a ring shape, and configured to rotatably receive the coupling outer ring-shaped protrusion; and a coupling inner ring-shaped groove depressed through the surface of the second coupling connection portion, engaging with the first coupling connection portion, in a ring shape while having a same center as the coupling outer ring-shaped groove but a smaller diameter than the coupling outer ring-shaped groove, and configured to rotatably receive the coupling inner ring-shaped protrusion, wherein when the coupling outer ring-shaped protrusion and the coupling inner ring-shaped protrusion are rotated in a state of having been inserted into the coupling outer ring-shaped groove and the coupling inner ring-shaped groove, respectively, the connection angle between the first coupling member and the second coupling member is varied, and wherein the first coupling member further comprises a first coupling through hole configured to pass through the first coupling connection portion while having a same center as the coupling outer ring-shaped protrusion and the coupling inner ring-shaped protrusion;

the second coupling member further comprises a second coupling through hole configured to pass through the second coupling connection portion while having a same center as the coupling outer ring-shaped groove and the coupling inner ring-shaped groove;

when the coupling outer ring-shaped protrusion and the coupling inner ring-shaped protrusion are inserted into the coupling outer ring-shaped groove and the coupling inner ring-shaped groove, respectively, the first coupling through hole and the second coupling through hole communicate with each other; and the coupling means comprises:

a female coupler configured to be brought from an outside of any one of the first coupling through hole and the second coupling through hole and to be sequentially passed through the first coupling through hole and the second coupling through hole that communicate with each other, wherein a coupling hole is formed through one surface of the female coupler to a predetermined depth in a longitudinal direction; and a male coupler configured to be brought from an outside of a remaining one of the first coupling through hole and the second coupling through hole and to be then fitted into the coupling hole of the female coupler in a state of having been sequentially passed through the first coupling through hole and the second coupling through hole, thereby connecting the first coupling member and the second coupling member to each other.

2. The rebar coupler of claim 1, wherein the rebar coupler further comprises a coupling body member to which at least one of the first coupling member and the second coupling member is rotatably connected by the coupling means.

* * * * *